United States Patent [19]

Kreider

[11] Patent Number: 4,721,069

[45] Date of Patent: Jan. 26, 1988

[54] TERMINATION FOR BOILER CASING EXPANSION ELEMENT

[75] Inventor: Edward W. Kreider, Wadsworth, Ohio

[73] Assignee: The Babcock & Wilcox Company, New Orleans, La.

[21] Appl. No.: 64,047

[22] Filed: Jun. 19, 1987

[51] Int. Cl.[4] ..... F22B 37/06; F22B 37/10

[52] U.S. Cl. ..... 122/511; 122/6 A; 122/510; 165/82

[58] Field of Search ..... 122/6 R, 6 A, 510, 511; 165/81, 82

[56] References Cited

U.S. PATENT DOCUMENTS

| | | | |
|---|---|---|---|
| 3,373,721 | 3/1968 | Sheikh | 122/510 X |
| 4,499,860 | 2/1985 | Loomis et al. | 122/510 |
| 4,576,120 | 3/1986 | Ammahn | 122/6 A |

*Primary Examiner*—Edward G. Favors

*Attorney, Agent, or Firm*—Robert J. Edwards; Vytas R. Matas; Eric Marich

[57] ABSTRACT

An attachment arrangement for attaching a boiler casing to a membrane tube wall utilizes an extension plate which is connected to and extends beyond an edge of the casing. The extension plate and the surface of the casing adjacent its edge define an attachment area which is attached to the tube wall. A slot extends in the casing and through part of the extension plate. The slot is covered by an expansion element having a termination covering the end of the slot. The termination is on the extension plate. The termination of the expansion element extending over the extension plate provides compensation for expansion in the attachment area which avoids deformation and tearing of the casing in this area.

11 Claims, 12 Drawing Figures

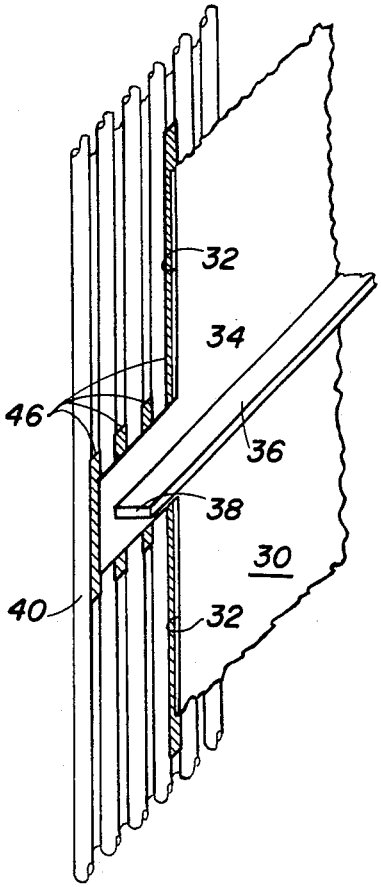
FIG. 2
FIG. 5
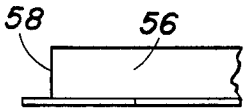
FIG. 6
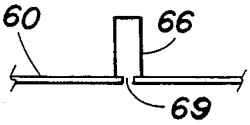

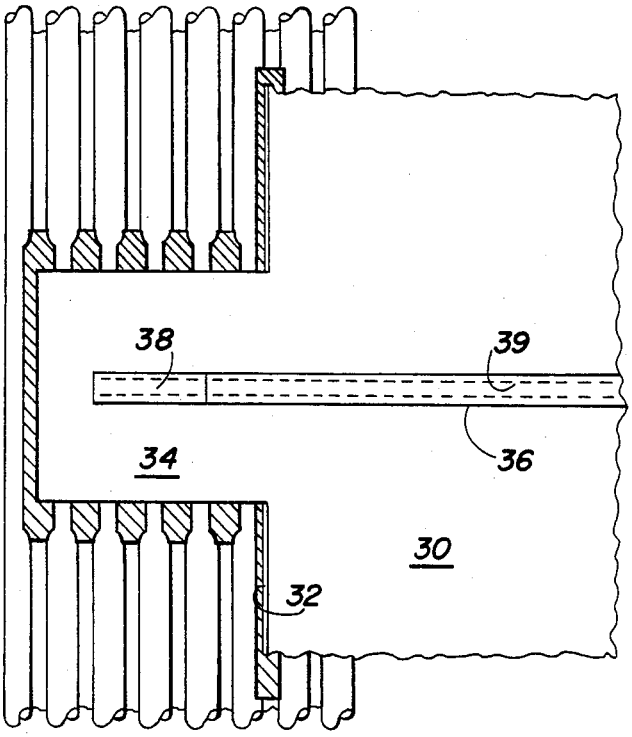
FIG. 3
FIG. 7
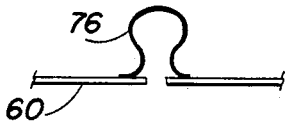
FIG. 8
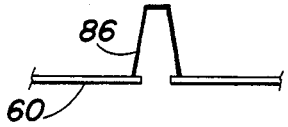
FIG. 9
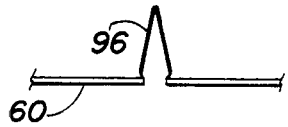
FIG. 10
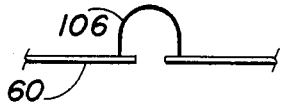

TERMINATION FOR BOILER CASING EXPANSION ELEMENT

BACKGROUND OF THE INVENTION

The present invention relates in general to vapor generators and, more particularly, to improved expansion elements for a fossil-fuel boiler casing connected to a membrane tube wall which resists tearing and distortion due to thermal expansion and contraction.

Most modern vapor generators have water-cooled wall panels known as membrane walls. The membrane walls are composed of rows of tubes, laterally spaced on centers wider than the tube diameter, which are connected by flat metal bars known as membranes. Thses bars are positioned 180° apart on the outside surface along the length of the tubes and continuously welded thereto and to adjacent tubes so as to form a continuous wall surface comprising an alternate succession of elongated circular tube surfaces and elongated flat membrane surfaces that are stepped inwardly of the outermost surface of the tubes within the intervening spaces between the tubes. The welds may be formed by various known means and are usually formed on both sides of the membrane wall.

Metallic sheets or plates, known as casing, are attached to the membrane wall to form a gas-tight cased enclosure, for example, such as a windbox for housing the vapor generator's burners and for distribution of combustion air. It is essential that the casing be connected to the membrane wall in a gas-tight manner.

Connection of the casing and membrane wall is accomplished by the placement of short blocks of filler bar in the spaces between the tubes, adjacent to the outer side of the membrane bars. An arrangement in which filler bars are welded in place between tubes is disclosed, for example, in U.S. Pat. No. 3,357,408. The filler bars are seal welded between adjacent tubes to provide a flush, continuous surface transversely across the tubes and the intervening spaces. The casing, in turn, is seal welded to the filler bars and tubes. This type of structural arrangement stiffens the tubes and restricts the ability of the tubes to expand and contract.

During operation of the vapor generator, considerable temperature differences between the membrane wall and the casing subject them to different amounts of thermal expansion. The stiffened arrangement, moveover, has been found to be quite sensitive to accelerated temperature excursions, such as are experienced in some cycling vapor generators during changes in the vapor generator's operating conditions, and may eventually lead to excessive thermal stresses and resultant tube failures.

U.S. Pat. No. 4,538,550 discloses a seal attachment for a casing. No expansion element is used in this structure.

U.S. Pat. No. 2,655,238 discloses a fluid heater casing for a vapor generator or boiler, comprising a plurality of flat plates which overlie an insulation layer which in turn, covers the furnace tube walls. To avoid thermal expansion, the edges of the plate do not touch each other.

U.S. Pat. No. 2,736,400 discloses a wall construction utilizing a plurality of rectangular, flanged seal pans that are seal welded together at their edges. The flaired construction of abutting seal pans provides a V-type expansion joint. A staggered arrangement of the seal pans avoids cumulative thermal expansion effects.

U.S. Pat. No. 3,310,038 discloses a gap sealing structure for components that are subject to three dimensional changes in position. A compensator element which has several possible cross sections including a C-shaped or omega-shaped cross section, is provided. The termination of the compensator is co-extensive with the attachment to the furnace tube wall and does not provide any special arrangement to avoid tearing or distortion of the casing at the termination of the compensator.

U.S. Pat. No. 3,479,994 and U.S. Pat. No. 3,592,171 disclose corner constructions for wrap-around windboxes and for a pressurized penthouse of a boiler, respectively. The use of an expansion joint having an accordion pleated or V-shaped cover plate over an arcuate slot is shown in U.S. Pat. No. 3,479,994. U.S. Pat. No. 3,592,171 uses an expansion joint having a U-shaped cross section to cover a slot in a plate. Here again, however, the slot and the expansion joint terminate at the same location.

U.S. Pat. No. 3,793,991 discloses an expansion plate or sheet having a plurality of trough-like depressions extending substantially the full distance between the two adjacent walls it connects. The device is particularly adapted for use in the connection between the lower headers at the outlet of an economizer of a boiler, and the hopper.

None of the aforementioned patents, however, teach the usefulness of a specially constructed termination for the expansion element of a casing which resists tearing and distortion of the casing at the attachment area to the tube wall.

SUMMARY OF THE INVENTION

An object of the present invention is to provide an expansion and attachment arrangement for steel casing to be attached to boiler tube walls which resist tearing and distortion of the casing at the attachment. The invention utilizes an expansion element which terminates in the casing to provide increased flexibility to the structure of the tube wall and casing. This better accomodates thermal differentials between the tube wall and the casing during transient operations of the boiler.

One particular use of the invention is for casing forming windboxes.

According to the present invention, the expansion element, which straddles a slot in the casing, extends beyond an outer edge of the casing in the area of the attachment for the casing to the tube wall. In this way, the expansion element terminates at a location which is subjected to minimal thermal stress. This feature also avoids the requirement for a stress raiser construction (end of casing slot) in high stress areas.

The expansion element, according to the invention, is located so that it can function at the main casing attachment to the tube wall where thermal stresses are at a maximum. The invention is a sharp diversion from standard practice wherein expansion elements are terminated at the main casing attachment. The conventional termination results in a stress concentration which can cause a casing failure.

The inventive arrangement advantageously eliminates casing failures at windboxes, plenums, and vestibule attachments to boiler tube walls. Such failures are costly to repair. Also, casing tears which may be caused by thermal expansion, result in the infiltration of air on balanced draft units which decreases unit efficiency. This results in secondary air losses in windboxes, which also decreases efficiency and may cause plant housekeeping problems. This results in higher maintenance costs of motors, control equipment and the like, in the balance of the plant, when casing failures occur on plenums of pressure-fired (coal) units. The escaping noxious gases resulting from pressure-fired boiler casing failures, are also a serious health hazard to operating and maintenance personnel.

In accordance with the invention, an attachment arrangement for a tube wall comprises a casing having an edge and an attachment surface near the edge, an extension plate connected to the casing and extending beyond the edge of the casing, an attachment area extending over said extension plate and over the attachment surface, said attachment area being attached to the tube wall, the casing having a slot extending therethrough past the edge of the casing and onto the extension plate, and an expansion element connected to the casing and to the extension plate on opposite sides of the slot for compensating expansion between portions of the casing on opposite sides of the slot, said expansion element having a closed termination extending over the extension plate and over the attachment area.

BRIEF DESCRIPTION OF THE DRAWING

In the accompanying drawings, forming a part of this specification, and in which reference numerals shown in the drawings designate like or corresponding parts throughout the same.

FIG. 2 is a partial perspective view of a non-wrap around windbox or plenum, casing attachment in accordance with the present invention;

FIG. 3 is a plan view of the attachment of FIG. 2;

FIG. 5 is an elevational view of the expansion element termination in accordance with another embodiment of the invention;

FIGS. 6 through 10 are respective sectional views taken through the expansion element in a portion of the casing, showing the cross section of various embodiments of the expansion element;

DESCRIPTION OF THE PREFERRED EMBODIMENTS

Figure 1:
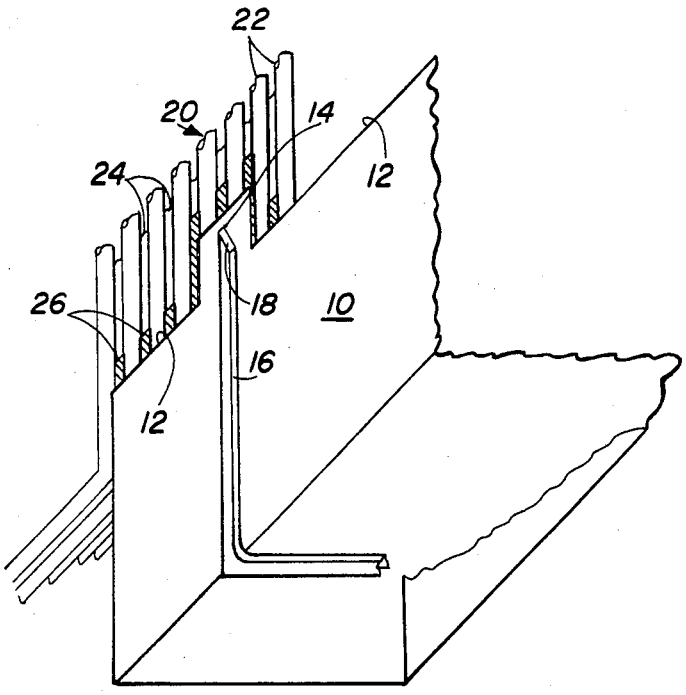
FIG. 1 is a partial perspective view of a windbox or plenum casing attachment to a boiler tube wall including the expansion element with expansion element termination in accordance with the present invention.

Referring to the drawings in particular, the invention embodied in FIG. 1 comprises an attachment arrangement for attaching a casing 10, such as the casing of a windbox or plenum, to a tube wall generally designated 20, comprising a plurality of tubes 22 which are connected to each other by flat, metal bars referred to as membranes 24.

Casing 10 has an outer edge 12 and an attachment surface facing the tube wall 20 in the vicinity of the edge 12. An extension plate 14 is connected to or formed as one part with the casing 10 and extends beyond edge 12. The under surface of extension plate 14 forms part of the attachment area which is welded to filling bars 26 which fill in the spaces between tubes 22 and membrane bars 24 so as to form a flat attachment surface. This flat attachment surface is co-extensive with the attachment area of the casing 10. Attachment can be achieved by seal welding of the casing surface to the flat tube wall surface.

An expansion element 16 is welded to casing 10 and extends up over the surface of expansion plate 14. Expansion element 16 straddles a slot which extends through the casing 10 up into the expansion plate 14. Expansion element 16 has a mitered termination 18 which covers the end of the slot (not shown in FIG. 1).

The embodiment of FIG. 2 shows a casing 30 having an edge 32 with an extension plate 34 connected to the edge and an expansion element 36 overlying a slot in the casing. The slot extends into the extension plate 34. Expansion element 36 straddles the slot and has a termination 38 covering the end of the slot. The attachment area between casing 30 and a tube wall 40 is also defined by a plurality of filler bars 46 which are connected to and extend under the extension plate 34 and the attachment surface of casing 30 adjacent to the edge 32.

The extent of slot 39, which extends into extension plate 34 and beyond edge 32, is best shown by dotted lines in FIG. 3.

Figure 4:
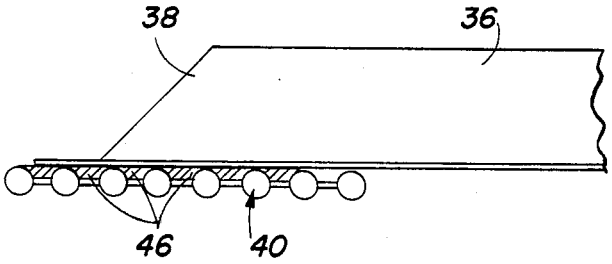
FIG. 4 is a sectional view, partly in elevation, of the attachment of FIG. 3.

FIG. 4 is a side elevation view of the expansion element 36 and the termination 38.

While the casing 10 of FIG. 1 may be of the wrap around type and can be attached to vertically extending tube walls, the casing of the embodiment of FIG. 2 is for non wrap around structures.

In the embodiments of FIGS. 1 through 4, the expansion element has a mitered termination 18 and 38 for the expansion element.

FIG. 5 illustrates an abrupt termination 58 for an expansion element 56.

As shown in FIG. 6, a channel-shaped expansion element 66 is provided which has a rectangular cross section with opposed legs, each connected to one portion of a casing 60 on opposite sides of a slot 69 in the casing.

FIG. 7 provides a view, similar to FIG. 6, illustrating an omega shaped expansion element.

FIG. 8 illustrates a further modified shape for the expansion element 86 while FIGS. 9 and 10 respectively show V-shaped expansion element 86 and C-shaped expansion element 106.

Figure 11:
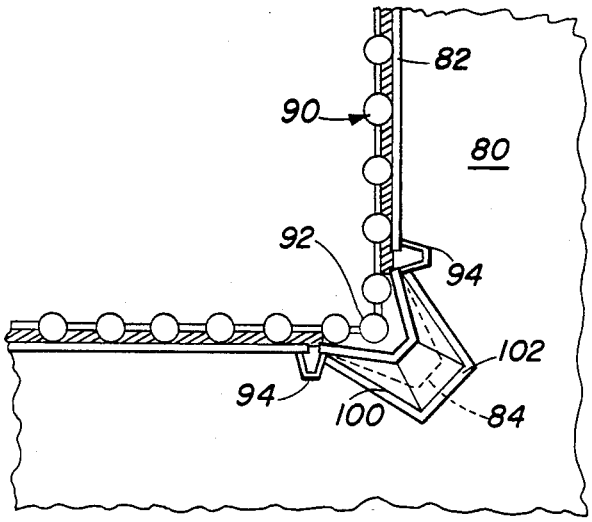
FIG. 11 is a top plan view of an outside corner area of the floor of a windbox having casing sidewalls connected to the outside corner of a tube wall.
Figure 12:
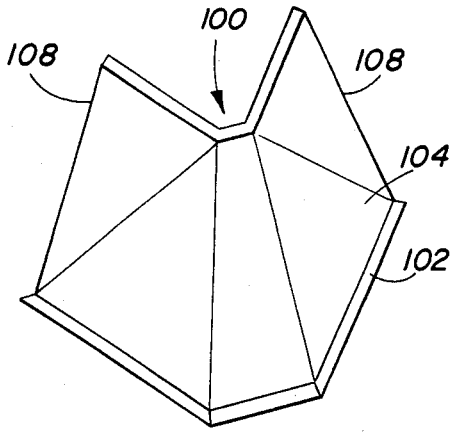
FIG. 12 is a perspective view of a corner construction for the corner area of the tube wall attachment of FIG. 11.

FIG. 11 is a top plan view of the floor 80 of a casing having sidewalls 82 which are connected at attachment areas to a tube wall 90 at an outside corner of the tube wall. The inside corner 84 of floor 80 is cut out to extend away from the corner 92 of tube wall 90. This corner area is covered by an expansion corner construction 100 which is connected to the sidewalls 82 by expansion elements 94. The bottom flange 102 of corner construction 100 is welded to the floor 80. Sidewalls 104 rise from the flange 102 and have edges 108 welded to one side of the expansion elements 94. In this way, expansion compensation is also provided for the corner area of a casing.

The invention claimed is:

1. An attachment arrangement for a membrane tube wall of a vapor generator, the attachment arrangement comprising a casing having an edge and an attachment surface near the edge, an extension plate connected to the casing and extending beyond the edge, said extension plate having an attachment surface, an attachment area extending over the attachment surfaces of the casing and the extension plate and being attached to the tube wall, the casing having a slot extending therein, the slot extending past the edge into the extension plate, an expansion element straddling the slot and being connected to the casing and to the extension plate on opposite sides of the slot and the expansion element having a termination covering an end of the slot and connected to said extension plate whereby thermal expansion and contraction of said casing in the vicinity of said attachment area is compensated for by said expansion element and termination to resist tearing and deformation of said casing in said attachment area.

2. An attachment arrangement according to claim 1 wherein the tube wall comprises a plurality of parallel tubes connected together by a plurality of membrane bars, the attachment area including filler bars filling spaces between said tubes on said membrane bars and being attached to said attachment surfaces of the casing and the extension plate.

3. An attachment arrangement according to claim 1 wherein said termination is mitered.

4. An attachment arrangement according to claim 1 wherein the termination is abrupt and unmitered.

5. An attachment arrangement according to claim 1 wherein the expansion element has a rectangular-shaped cross section.

6. An attachment arrangement according to claim 1 wherein the expansion element has an omega-shaped cross section.

7. An attachment arrangement according to claim 1 wherein the expansion element has a V-shaped cross section.

8. An attachment arrangement according to claim 1 wherein the expansion element has a C-shaped cross section.

9. An attachment arrangement according to claim 2 wherein the expansion element extends parallel to said tubes.

10. An attachment arrangement according to claim 2 wherein the extension plate extend perpendicularly to said tubes.

11. An attachment arrangement according to claim 1 wherein the casing has a floor with an inside corner, the tube wall having an outside corner embraced by the inside corner, and a corner construction connected to the casing floor and extending over at least a portion of the outside corner of the tube wall, the casing having at least one side wall carrying the expansion element, the expansion element being connected to the corner construction.

* * * * *